US010893715B2

(12) United States Patent
Noll

(10) Patent No.: US 10,893,715 B2
(45) Date of Patent: Jan. 19, 2021

(54) HOOD ADJUSTING MECHANISM

(71) Applicant: NIKE, Inc., Beaverton, OR (US)

(72) Inventor: Eric Noll, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 324 days.

(21) Appl. No.: 15/679,823

(22) Filed: Aug. 17, 2017

(65) Prior Publication Data

US 2018/0049499 A1 Feb. 22, 2018

Related U.S. Application Data

(60) Provisional application No. 62/377,034, filed on Aug. 19, 2016.

(51) Int. Cl.

| | |
|---|---|
| ***A42B 1/04*** | (2006.01) |
| ***A42B 1/06*** | (2006.01) |
| ***A41D 3/00*** | (2006.01) |

(52) U.S. Cl.

CPC ..... *A42B 1/048* (2013.01); *A41D 3/005* (2013.01); *A42B 1/066* (2013.01); *A41D 2200/20* (2013.01)

(58) Field of Classification Search

CPC ..... A42B 1/048; A42B 1/066; A41D 3/005; A41D 2200/20

See application file for complete search history.

(56) References Cited

U.S. PATENT DOCUMENTS

| | | | | |
|---|---|---|---|---|
| 4,334,325 A | | 6/1982 | Walkuski | |
| 5,369,809 A | * | 12/1994 | Hall | A41D 3/00 2/202 |
| 5,832,538 A | | 11/1998 | Williams | |
| 6,023,787 A | | 2/2000 | French et al. | |
| 6,370,692 B1 | | 4/2002 | Duyn et al. | |
| 6,374,418 B1 | * | 4/2002 | Rindle | A42B 1/048 2/202 |

(Continued)

FOREIGN PATENT DOCUMENTS

| | | |
|---|---|---|
| EP | 0673609 A1 | 9/1995 |
| EP | 1867243 B1 | 3/2011 |

(Continued)

OTHER PUBLICATIONS

Dawson, Lisa, "La Sportiva's New Fern Apparel—Bella Mia!," The Backcountry Skiing Blog, wildsnow.com, Nov. 29, 2012. https://www.wildsnow.com/8716/la-sportiva-backcountry-ski-apparel/.

(Continued)

*Primary Examiner* — Clinton T Ostrup
*Assistant Examiner* — Andrew Wayne Sutton
(74) *Attorney, Agent, or Firm* — Shook, Hardy & Bacon, L.L.P.

(57) ABSTRACT

The present invention is directed toward a hood adjusting mechanism for improving the fit and adjustability of a hood over a wearer's head when worn by the wearer and may include a hood portion with a generally circumferential opening, a first and second aperture, and a first and second channel. In addition, the hood adjusting mechanism may further include a first and second continuous cord that extend through the first and second channels, exit at the first and second apertures, and are releasably secured by a tightening mechanism. The hood adjusting mechanism may be included as part of an apparel item with a body portion, such as a jacket or a coat.

17 Claims, 5 Drawing Sheets

(56) References Cited

U.S. PATENT DOCUMENTS

| | | | | |
|---|---|---|---|---|
| 6,442,763 | B1 | 9/2002 | Larson et al. | |
| 6,654,963 | B2 | 12/2003 | Fayle et al. | |
| 7,380,286 | B1 | 6/2008 | Bryant, Sr. | |
| 8,438,665 | B2 | 5/2013 | Roemer et al. | |
| 10,251,439 | B2 * | 4/2019 | Rolfe | A42B 1/048 |
| 2004/0055069 | A1 | 3/2004 | Clarke Fayle et al. | |
| 2005/0108804 | A1 * | 5/2005 | Bush | A41D 3/00 2/84 |
| 2005/0241045 | A1 | 11/2005 | Tolton | |
| 2010/0064417 | A1 | 3/2010 | Fruge | |
| 2014/0317829 | A1 | 10/2014 | Rolfe | |
| 2018/0271189 | A1 * | 9/2018 | Hussey | A41D 13/1184 |

FOREIGN PATENT DOCUMENTS

| | | | |
|---|---|---|---|
| GB | 2419803 | A * | 5/2006 |
| JP | 3724824 | B2 | 12/2005 |

OTHER PUBLICATIONS

"Theta AR Jacket Men's," ARC'TERYX, arcteryx.com, accessed: Jun. 2016 http://www.arcteryx.com/product.aspx?language=EN&model=Theta-AR-Jacket.

"Rab Stretch Neo Jacket Preview," GEAR:30, gearthrity.com, accessed: Jun. 2016. http://gearthirty.com/rab-stretch-neo-jacket-preview/.

"Black Diamond: Men's Heat Treat Hoody Jacket," Altitude Sports, altitude-sports.com, accessed Jun. 2016. http://www.altitude-sports.com/en/black-diamond-mens-heat-treat-hoody-jacket-bdd-aps4ya-en.

Haglofs Oz Pullover Jacket Review, John Laughlin: Adventure Racing News, Gear Reviews, and Race Reports, johnlaughlin.co.uk, accessed: Jun. 2016. http://www.johnlaughlin.co.uk/2009/12/haglofs-oz-pullover-jacket-review/.

Zosel, Kristin, "Ultimate Direction Women's Ultra Jacket Review," iRunFar, Irunfar.com, Mar. 31, 2016. http://www.irunfar.com/2016/03/ultimate-direction-womens-ultra-jacket-review.html.

International Search Report and Written Opinion dated Oct. 25, 2017 in International Patent Application No. PCT/US2017/047571, 16 pages.

Intention to Grant received for European Patent Application No. 17758404.2, dated Apr. 30, 2020, 6 pages.

International Preliminary Report on Patentability dated Feb. 28, 2019 in International Patent Application No. PCT/US2017/047571, 9 pages.

* cited by examiner

HOOD ADJUSTING MECHANISM

CROSS-REFERENCE TO RELATED APPLICATIONS

This application, having U.S. application Ser. No. 15/679,823, filed on Aug. 17, 2017, and entitled "HOOD ADJUSTING MECHANISM," claims the benefit of U.S. Provisional Application No. 62/377,034, filed on Aug. 19, 2016, and entitled "HOOD ADJUSTING MECHANISM," the entirety of which is incorporated by reference herein.

FIELD OF THE INVENTION

The present disclosure relates to a hood adjusting mechanism for improving the fit and adjustability of a hood when worn by a wearer.

BACKGROUND

Traditional apparel items, such as jackets or coats, for cool or cold-weather athletic activities commonly feature a hood to provide additional warmth or protection from the elements to a wearer's head. When worn, the hood loosely covers the back and top of a wearer's head and presents a frontal opening around the wearer's face. Generally, the fit of the hood is adjusted by tightening or loosening a cord or string that extends along the front edge of the hood and changes the size of the frontal opening.

BRIEF DESCRIPTION OF THE DRAWINGS

Examples of the present invention are described below with reference to the attached drawing figures, wherein.

DETAILED DESCRIPTION

Figure 1:
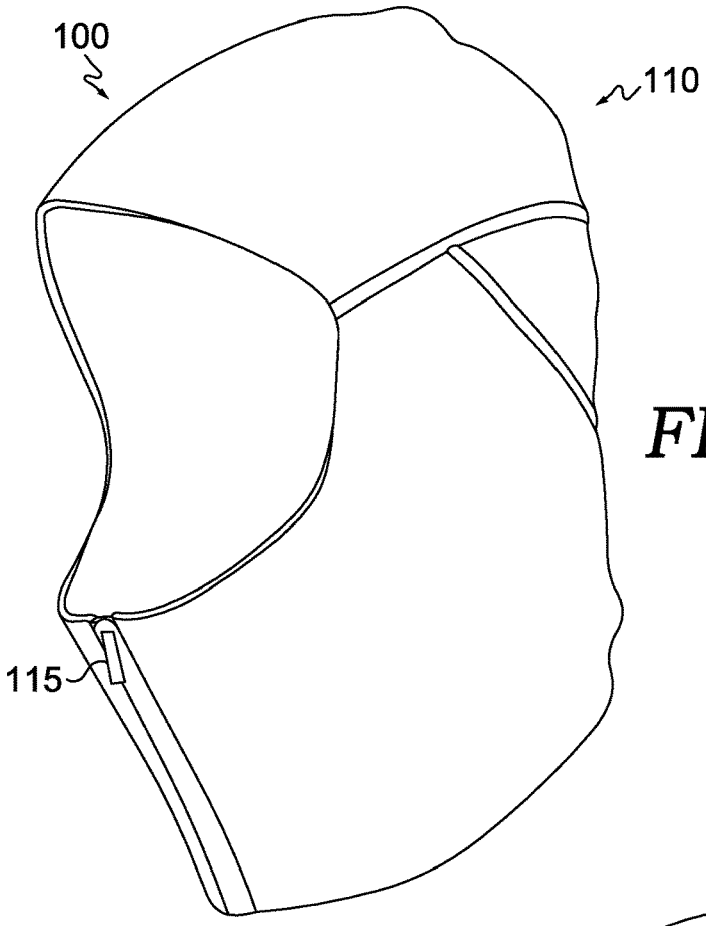
FIG. 1 illustrates a perspective front view of a hood including an exemplary hood adjusting mechanism in accordance with aspects herein.

The subject matter of the present invention is described with specificity herein to meet statutory requirements. However, the description itself is not intended to limit the scope of this disclosure. Rather, the inventors have contemplated that the claimed and disclosed subject matter might also be embodied in other ways, to include different aspects or combinations of aspects similar to the ones described in this document, in conjunction with other present or future technologies.

At a high level, aspects herein are directed toward a hood adjusting mechanism for improving the fit and adjustability of a hood over a wearer's head when worn by the wearer and may include a hood portion with a generally circumferential opening, a first and second aperture, and a first and second channel. In addition, the hood adjusting mechanism may further include a first and second continuous cord that extend through the first and second channels, exit at the first and second apertures, and are releasably secured by a tightening mechanism. In further aspects, the hood adjusting mechanism may be included as part of an apparel item with a body portion, such as a jacket or a coat.

The hood adjusting mechanism may comprise a hood portion, a first continuous cord, a second continuous cord, and a tightening mechanism. More specifically, the hood portion may be configured to at least partially cover a head area of a wearer in an-worn position and may include a generally circumferential opening, a first aperture, a second aperture, a first channel, and a second channel. The circumferential opening may be defined by at least a right side portion and a left side portion, and the first and second apertures may be located on a back side of the hood portion at a first aperture location and a second aperture location, respectively. Further, the first channel may include a first portion extending from the first aperture location to the right side portion of the circumferential opening and a second portion extending from the second aperture location to the right side portion of the circumferential opening. Likewise, the second channel may include a third portion extending from the first aperture location to the left side portion of the circumferential opening and a fourth portion extending from the second aperture location to the left side portion of the circumferential opening. Additionally, the first continuous cord may extend through the first and second portions of the first channel, exit at the first and second apertures, and further extend between the first and second apertures. In the same manner, the second continuous cord may extend through the third and fourth portions of the second channel, exit at the first and second apertures, and further extend between the first and second apertures. The tightening mechanism may be positioned proximate to the first and second aperture locations and may be configured to releasably secure the first continuous cord and the second continuous cord.

Further aspects herein relate to an apparel item with a hood adjusting mechanism, and the apparel item may comprise a body portion, a hood portion, a first continuous cord, a second continuous cord, and a tightening mechanism. More particularly, the body portion may be configured to at least partially cover a torso area of a wearer when the apparel item is worn, and the hood portion, the first continuous cord, the second continuous cord, and the tightening mechanism may include the aspects discussed in the foregoing paragraph as well as additional aspects discussed below. Generally, the hood portion, the first continuous cord, the second continuous cord, and the tightening mechanism may include any and all aspects, and any variation thereof, contemplated herein, and may be interchangeable aspects of the hood adjusting mechanism or the apparel item with a hood adjusting mechanism.

In other aspects, the first continuous cord may comprise a first end, a second end, a first cord body extending between the first and second ends, and a first junction formed by an attachment of the second end to the first cord body at a predetermined distance from the first end. Further, the first cord body may comprise a first segment extending from the first end to the first junction and a first loop extending continuously between the first junction and the second end. In an alike manner, the second continuous cord may comprise a third end, a fourth end, a second cord body extending between the third and fourth ends, and a second junction formed by an attachment of the fourth end to the second cord body at a predetermined distance from the third end. Moreover, the second cord body may comprise a second segment extending from the third end to the second junction and a second loop extending continuously between the second junction and the fourth end.

In exemplary aspects, the hood adjusting mechanism may be configured such that the hood portion may be comfortably adjusted and uniformly tightened over a wearer's head when in an as-worn position without causing the circumferential opening to impede over the wearer's face. More specifically, the hood adjusting mechanism may provide the ability to simultaneously tighten the first and second continuous cords by using the tightening mechanism. In more detail, the tightening mechanism and the first and second continuous cords may be configured such that the wearer may easily adjust or tighten the hood portion with one hand. Further, by using two channels on opposing sides of the hood portion with two apertures, the hood adjusting mechanism allows for the hood portion to be pulled over the wearer's head in multiple directions. Accordingly, the hood adjusting mechanism affords a more uniform tightening of a hood than traditional tightening mechanisms. Therefore, the hood adjusting mechanism provides a hood with improved fit and adjustability that may be easily tightened without unduly encroaching over the wearer's face.

Turning now to FIG. 1, a hood including an exemplary hood adjusting mechanism 100 in accordance with aspects herein is illustrated from a perspective front view. While aspects discussed herein generally refer to hoods, it will be understood that aspects are not limited solely to hoods, but rather, may also be applied to any apparel item with a hood or a suitable opening. Further, the depictions in the figures are for exemplary purposes only and are in no way meant to limit the scope of the present invention. For instance, although the hood adjusting mechanism 100 is shown without an apparel item in FIGS. 1-7, the hood adjusting mechanism 100 may be included as part of an apparel item such as a jacket, coat, hooded shirt or sweatshirt, or any other type of apparel having a hood. Moreover, the hood adjusting mechanism 100 is not limited to use with a hood and may be included on any apparel item with a suitable opening. As used herein, the term "apparel item" shall broadly refer to any item of clothing with a hood or suitable opening and encompass any terminology commonly known or used in the art such as article of clothing, clothing device, and the like.

As used throughout this disclosure, the term "as-worn position" or "worn" means the hood adjusting mechanism 100 as worn by a wearer standing in anatomical position as that term is known in the art. Further, terms such as "anterior," "posterior," "lateral," "medial," "superior," "inferior," and "mid-axillary" are meant to be given their common anatomical meanings and are used with respect to the hood adjusting mechanism 100 being in the as-worn position. Further, when used in this disclosure, the terms "affixing," "coupling," or "securing" may comprise releasably affixing two items together via, for instance, buttons, snaps, zippers, hook-and-loop fasteners, and the like, and may also comprise permanently affixing two items together via, for example, stitching, bonding, adhesives, welding, and the like. Any and all aspects, and any variation thereof, are contemplated as being within the scope herein.

As shown in FIG. 1, the hood adjusting mechanism 100 may comprise a hood portion 110 configured to partially cover a head area of a wearer in an as-worn position. In some aspects, the hood portion 110 may comprise a front right panel and a left front panel that may be releasably secured to each other via a zipper-type mechanism 115. Thus, the hood adjusting mechanism 100 may be donned by the wearer by adjusting the zipper-type mechanism 115 to an unsecured position and then placing the hood portion 110 over the wearer's head. However, in other aspects, the hood adjusting mechanism 100 may not include the zipper-type mechanism 115 and may be donned simply by pulling the hood portion 110 over the wearer's head. The hood portion 110 may be constructed from any type of textile or non-textile material, such as a knitted material, a woven material, a film material, leather, non-woven, and the like. The material forming the hood portion 110 may be organic (e.g., cotton, wool, leather) or inorganic (e.g., nylon, polyester). Further, it is contemplated that combinations of materials may be implemented to construct one or more aspects of the hood portion 110.

Figure 2:
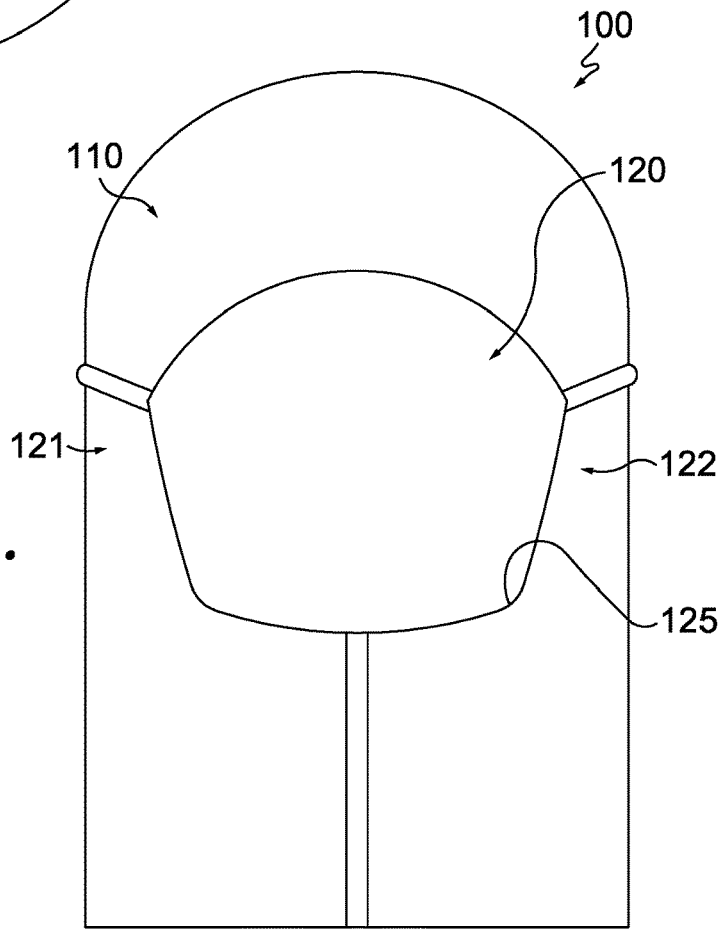
FIG. 2 illustrates a front view of the hood including the exemplary hood adjusting mechanism of FIG. 1 in accordance with aspects herein.

In FIGS. 2-5, the exemplary hood adjusting mechanism 100 of FIG. 1 is depicted from the front, back, and sides, respectively. The hood portion 110 may comprise a generally circumferential opening 120, a first aperture 151, a second aperture 152, a first channel 131, and a second channel 132. At the front and as shown in FIG. 2, the circumferential opening 120 may at least be defined by a right side portion 121 and a left side portion 122 and may be configured to form a perimeter edge 125 of the hood portion 110 around a wearer's face in an as-worn position. Thus, "generally circumferential" when used herein shall include a circular or oval shape like that of the wearer's face.

Figure 3:
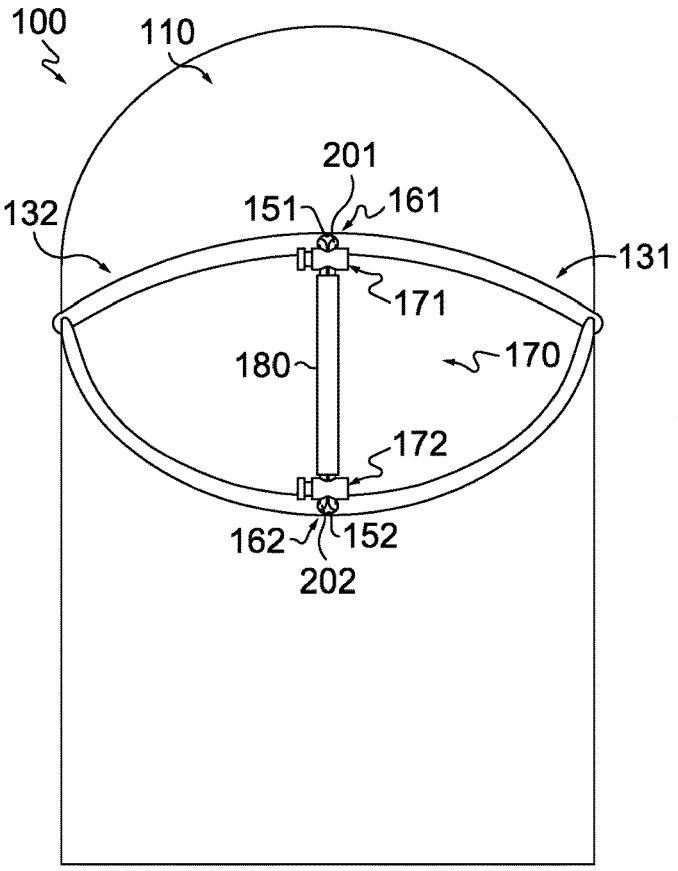
FIG. 3 illustrates a back view of the hood including the exemplary hood adjusting mechanism of FIG. 1 in accordance with aspects herein.

As seen in FIG. 3, the first aperture 151 may be positioned at a first aperture location 161 on a back side of the hood portion 110, and the second aperture 152 may be positioned at a second aperture location 162 on the back side of the hood portion 110. The first and second apertures 151, 152 may be partial perforations or holes in the hood portion 110 and may be configured to present openings to the first and second channels 131, 132. For instance, in one exemplary aspect, the hood portion 110 may be formed of an inner and an outer panel, and the first and second apertures 151, 152 may extend through the outer panel to provide a communication path to the first and second channels 131, 132 located between the inner and outer panels. In other aspects, the first and second apertures 151, 152 may be engineered into a textile or material that forms the hood portion 110 or an apparel item, which includes the hood portion 110. Further, the first and second apertures 151, 152 may each include one hole or perforation presenting a shared opening for both the first and second channels 131, 132 or may each include two holes or perforations presenting separate openings for the first and second channels 131, 132. In exemplary aspects, the first and second aperture locations 161, 162 may be positioned such that the first aperture location 161 is superior to and in vertical alignment with the second aperture location 162 when the hood adjusting mechanism 100 is in an as-worn position. Further, the vertical alignment of the first and second aperture locations 161, 162 may be along a midline of the hood portion 110.

Figure 4:
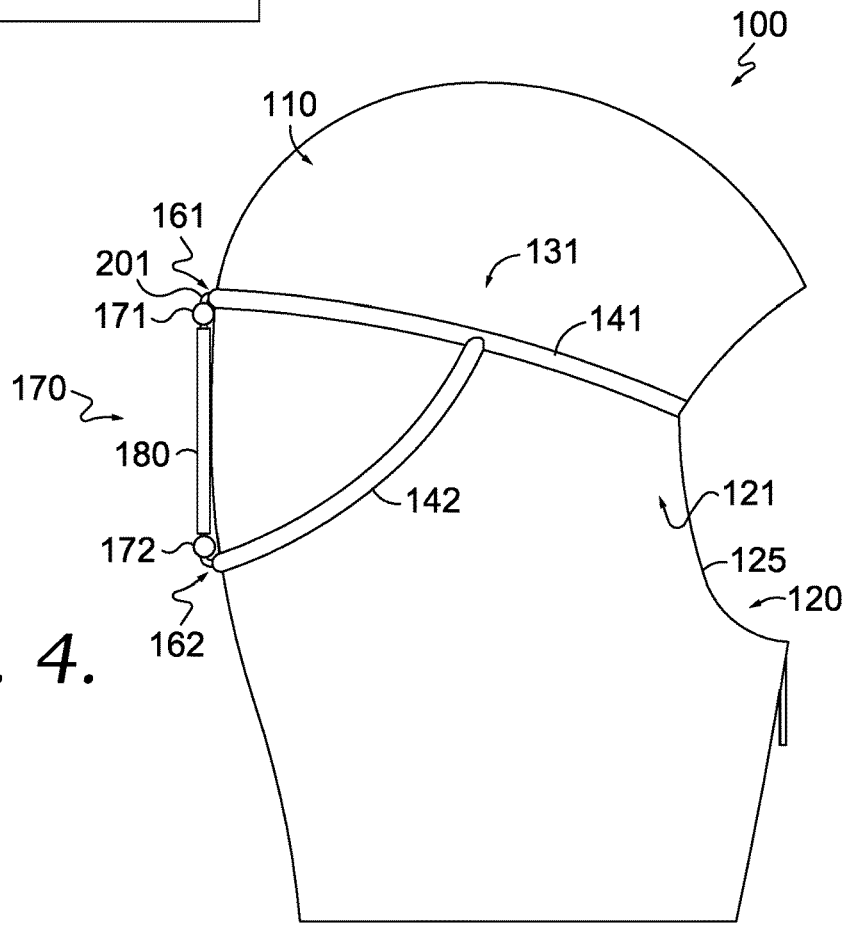
FIG. 4 illustrates a right side view of the hood including the exemplary hood adjusting mechanism of FIG. 1 in accordance with aspects herein.

With reference now to FIGS. 2-5, the first and second channels 131, 132 may form hollow, continuous or partially continuous voids about the hood portion 110 with openings formed by the first and second apertures 151, 152 and further, each may be configured to house a cord, string, or other cylindrical object. Moreover, the first and second channels 131, 132 may be positioned within the hood portion 110 and be formed by or between layers of material of the hood portion 110. In some aspects, the first and second channels 131, 132 may be integrally woven or knit into the hood portion 110 or may also be engineered into a textile or material that forms the hood portion 110 or an apparel item including the hood portion 110. Alternatively, the first and second channels 131, 132 may be externally affixed to the hood portion 110. As such, the first and second channels 131, 132 may provide a pathway for a cord or string to extend about the hood portion 110 from the circumferential opening 120 to the first and second apertures 151, 152. For example and as shown in FIG. 4, the first channel 131 may comprise a first portion 141 and a second portion 142, with the first portion 141 extending from the first aperture location 161 to the right side portion 121 of the circumferential opening 120 and the second portion 142 extending from the second aperture location 162 to the right side portion 121 of the circumferential opening 120. The first portion 141 may extend in a substantially linear manner, and the second portion 142 may extend in a substantially curvilinear manner. Similarly and with reference to FIG. 5, the second channel 132 may comprise a third portion 143 and a fourth portion 144. The third portion 143 may extend in a substantially linear manner from the first aperture location 161 to the left side portion 122 of the circumferential opening 120, and the fourth portion 144 may extend in a substantially curvilinear manner from the second aperture location 162 to the left side portion 122 of the circumferential opening 120.

In further aspects, when the hood adjusting mechanism 100 is in an as worn position, the first and third portions 141, 143 may extend in a generally horizontal manner, and the second and fourth portion 142, 144 may extend angularly downward along the hood portion 110. In addition, the second and fourth portions 142, 144 may respectively join with the first and third portions 141, 143 at a predetermined distance, variable between 1 cm and 15 cm, from the perimeter edge 125 of the circumferential opening 120. The second and fourth portions 142, 144 and the first and third portions 141, 143 may also join proximate to the circumferential opening 120 at a variable distance between 0.5 cm and 5 cm from the perimeter edge 125. In other aspects, the second and fourth portions 142, 144 and the first and third portions 141, 143 may be configured to respectively join at other locations relative to a total distance between the perimeter edge 125 and the first aperture location 161 and thus, may join at a third or a fourth of the total distance from the perimeter edge 125, which may include a variable distance between 5 cm and 15 cm from the perimeter edge 125. In even further aspects, the second and fourth portions 142, 144 and the first and third portions 141, 143 may be configured to respectively join relative to wearer's head when the hood adjusting mechanism 100 is in and as-worn position. As such, the second and fourth portions 142, 144 and the first and third portions 141, 143 may join at a location approximately positioned at a center of each respective side of the wearer's head when the hood adjusting mechanism 100 is in and as-worn position, which may include a variable distance between 10 cm and 20 cm from the perimeter edge 125. Furthermore, after being joined with the second and fourth portions 142, 144, the first and third portions 141, 143 may individually extend toward the perimeter edge 125 of the circumferential opening 120.

Referring back to FIGS. 3-5, the exemplary hood adjusting mechanism 100 may further comprise a tightening mechanism 170, a sheath 180, a first continuous cord 201, and a second continuous cord 202. The tightening mechanism 170 may be configured to releasably secure the first and second continuous cords 201, 202, either simultaneously or separately. Further, the tightening mechanism 170 may be positioned proximate to the first and second aperture locations 161, 162 and in an as-worn position, may be positioned vertically between the first and second aperture locations 161, 162. Additionally, the tightening mechanism 170 may be affixed to the hood portion 110.

In exemplary aspects, the tightening mechanism 170 may comprise a friction buckle although other types of buckles are contemplated herein such as tri-glides, ladder locks, cinch locks, cord-locks and the like. Moreover, the tightening mechanism 170 may include a housing and a plunger, both of which may include at least one through-channel that may serve as a passage for the first and second continuous cords 201, 202. The housing and the plunger may be moveably coupled and may also include a spring configured to affect the alignment of the through-channels. For example, the plunger may be depressed by an external force that presses against the spring, bringing the through-channels toward alignment. As the through-channels become more aligned, the first and second continuous cords 201, 202 passing therethrough are more easily moveably than when the through-channels are less aligned. Conversely, in the absence of an external force depressed on the plunger, the through-channels may be positioned away from alignment, and the first and second continuous cords 201, 202 passing therethrough are secured and/or maintained. In addition, the housing, the plunger, and the spring may be configured such that the first and second continuous cords 201, 202 may be moveable in the through-channels in a first direction and also secured or prevented from moving in a second direction that is opposite the first direction. As such, the first and second continuous cords 201, 202 may be pulled by a wearer and moved in the first direction in the through-channels and once released by the wearer, the first and second continuous cords 201, 202 may be secured or prevented from moving backward or in the second direction in the through-channels.

In other aspects, the tightening mechanism 170 may comprise a first cord lock 171 that may be positioned proximate to the first aperture location 161, and a second cord lock 172 that may be positioned proximate to the second aperture location 162. The first and second cord locks 171, 172 may be configured to operate independently and thus, a wearer may adjust the first cord lock 171 to releasably secure the first and second continuous cords 201, 202 without adjusting the second cord lock 172 and vice versa. Furthermore, the first and second cord locks 171, 172 may be affixed to the hood portion 110 at their respective positions. In further aspects, the tightening mechanism 170 may include multiple cord locks like the first and second cord lock 171, 172 or may only include a single cord lock which may be either the first cord lock 171 or the second cord lock 172 as well as any other similar cord lock mechanisms described herein.

Figure 5:
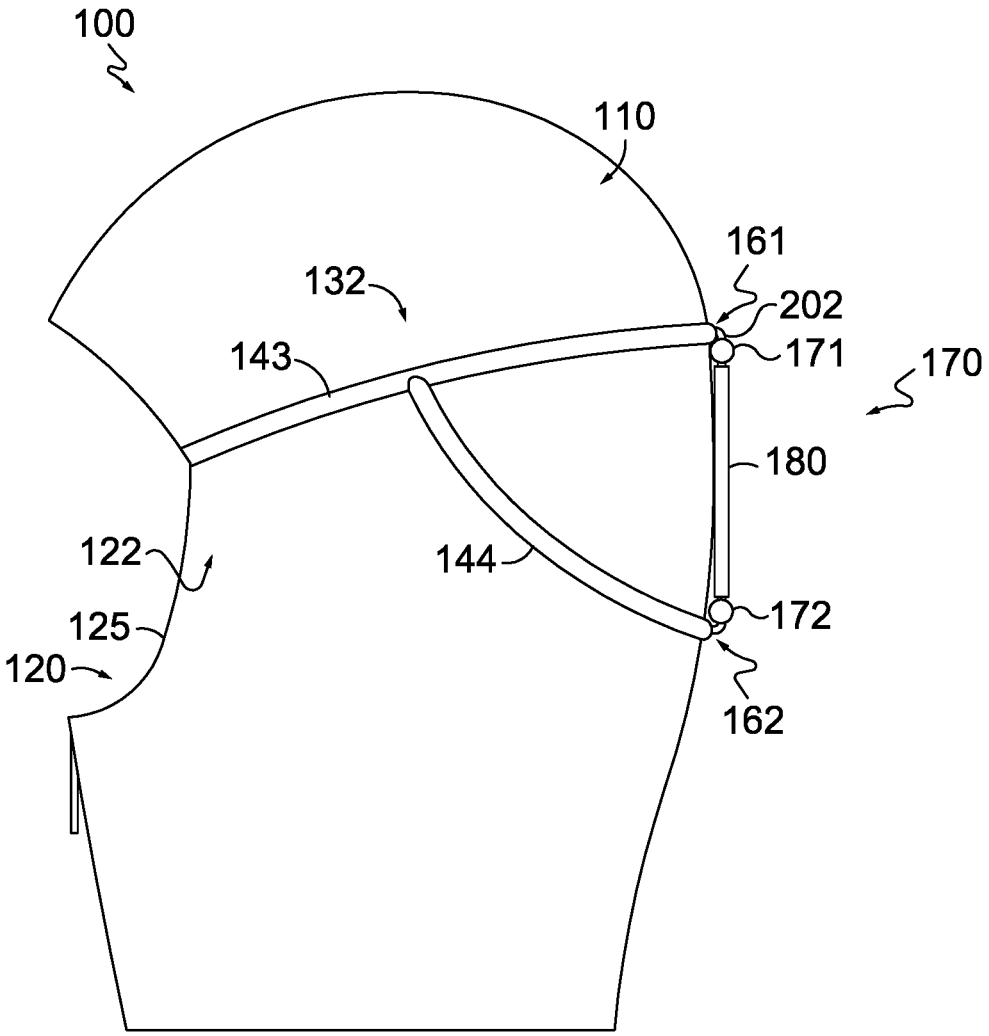
FIG. 5 illustrates a left side view of the hood including the exemplary hood adjusting mechanism of FIG. 1 in accordance with aspects herein.

Continuing with FIGS. 3-5, the sheath 180 may be configured to encase both the first and second continuous cords 201, 202 along a portion positioned exteriorly to the hood portion 110, thereby restricting the first and second continuous cords 201, 202 to an integral configuration. Accordingly, a wearer may concurrently tighten or pull the first and second continuous cords 201, 202 by imparting a pulling motion to the sheath 180. In further aspects, the sheath 180 may extend vertically between the first and second aperture locations 161, 162 and may be made of a material such as rubber, plastic, polyurethane, thermoplastic polyurethane, silicone, and the like. The sheath 180 may optionally be included with the hood adjusting mechanism 100.

Figure 6:
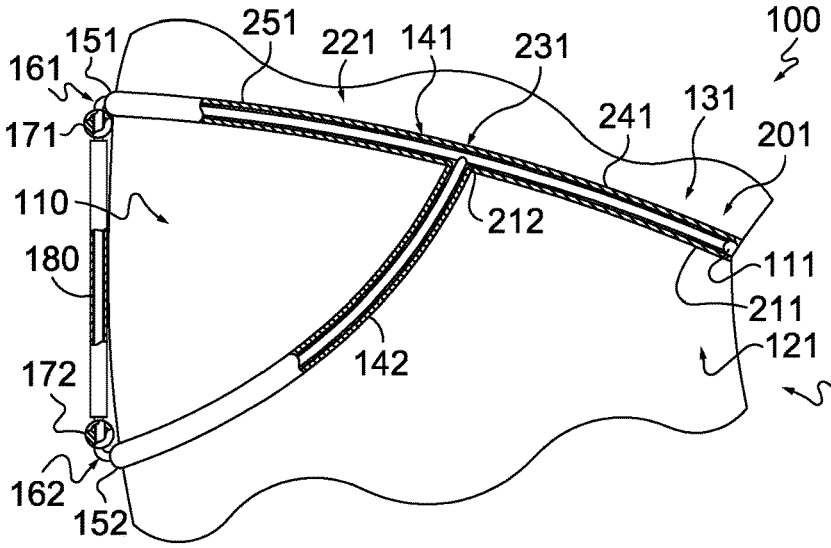
FIG. 6 illustrates a right side view of a portion of the hood including the exemplary hood adjusting mechanism of FIG. 1 with a portion partially removed in accordance with aspects herein.
Figure 7:
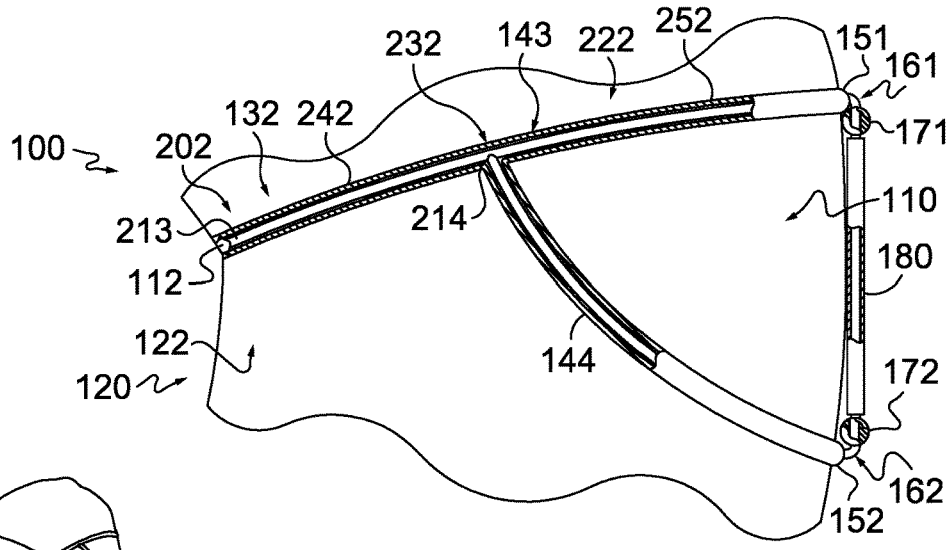
FIG. 7 illustrates a left side view of a portion of the hood including the exemplary hood adjusting mechanism of FIG. 1 with a portion partially removed in accordance with aspects herein.

Now to FIGS. 6-7, the sides of the hood including the exemplary hood adjusting mechanism 100 of FIG. 1 with portions removed are depicted and an internal view of the first and second channels 131, 132 is provided as shown. As shown, the first and second continuous cords 201, 202 may be positioned within the first and second channels 131, 132 and extend therethrough. More specifically, the first continuous cord 201 may extend through the first and second portions 141, 142 of the first channel 131, exit at the first and second apertures 151, 152, and then further extend between the first and second apertures 151, 152. Likewise, the second continuous cord 202 may extend through the third and fourth portions 143, 144 of the second channel 132, exit at the first and second apertures 151, 152, and then further extend between the first and second apertures 151, 152. The first and second continuous cords 201, 202 may, in exemplary aspects, be formed from materials having some degree of elasticity such as rubber, spandex, thermoplastic polyurethane (TPU), etc.

Staying with FIGS. 6 and 7, the hood portion 110 may further comprise a first anchoring structure 111 and a second anchoring structure 112. The first anchoring structure 111 may be positioned within the first channel 131 and secured proximate the right side portion 121 of the circumferential opening 120, and the second anchoring structure 112 may be positioned within the second channel 132 and secured proximate the left side portion 122. In additional aspects, the first and second anchoring structures 111, 112 may be secured within the first and second channels 131, 132 through mechanical pressure, stitching, bonding, adhesives, and the like. Moreover, the first and second anchoring structures 111, 112, may be formed of any materials that may form the hood portion 110 and may also be formed of other fabric material, a rubber material, a polyurethane or thermoplastic polyurethane material, and the like. In exemplary aspects, the first continuous cord 201 may be joined to the right side portion 121 of the circumferential opening 120 via the first anchoring structure 111, and the second continuous cord 202 may be joined to the left side portion 122 of the circumferential opening 120 via the second anchoring structure 112. The first and second continuous cords 201, 202 may be secured to the first and second anchoring structures 111, 112, respectively, through mechanical pressure, stitching, bonding, adhesives, and the like.

In accordance with aspects herein and with reference to FIG. 6, the first continuous cord 201 may comprise a first end 211, a second end 212, a first cord body 221, and a first junction 231 formed by an attachment of the second end 212 to the first cord body 221 via, for instance, stitching, bonding, adhesives, welding, and the like. The first cord body 221 may extend between the first and second ends 211, 212 and may include a first segment 241 extending from the first end 211 to the first junction 231 and a first loop 251 extending continuously between the first junction 231 and the second end 212. Moreover, the first junction 231 may be positioned at a predetermined distance, variable between 1 cm and 10 cm, from the first end 211. In a similar manner and as shown in FIG. 7, the second continuous cord 202 may comprise a third end 213, a fourth end 214, a second cord body 222, and a second junction 232 formed by an attachment of the fourth end 214 to the second cord body 222 via, for instance, stitching, bonding, adhesives, welding, and the like. The second cord body 222 may extend between the third and fourth ends 213, 214 and may include a second segment 242 extending from the third end 213 to the second junction 232 and a second loop 252 extending continuously between the second junction 232 and the fourth end 214. Further, the second junction 232 may be positioned at a predetermined distance, variable between 1 cm and 10 cm, from the third end 213.

In other aspects, the first and second channels 131, 132 and the first and second continuous cords 201, 202 may be configured in a complementary manner. Accordingly, the size and structure of the first and second channels 131, 132 may be slightly larger than the first and second continuous cords 201, 202 such that the first and second continuous cords 201 202 may freely move within the first and second channels 131, 132 but may be restricted in respect to the first and second channels 131, 132 location about the hood portion 110. Additionally, the first and second channels 131, 132 may reflect the particular components of the first and second continuous cords 201, 202. For instance, the first and second channels 131, 132 may divert from a single passageway near the circumferential opening 120 to a dual passageway to reflect differing components of the first and second continuous cords 201, 202 such as the first and second segments 241, 242 and the first and second loops 251, 252. As such, the first and second junctions 231, 232 may be positioned at multiple predetermined distances from the first and third ends 211, 213, respectively, to reflect a configuration of the first and second channels 131, 132. Such predetermined distances from the first and third ends 211, 213, respectively, include distances variable between 1 cm and 15 cm, 0.5 cm and 5 cm, 5 cm and 15 cm, or 10 cm and 20 cm.

In some aspects, the first and second continuous cords 201, 202 may be respectively joined at the first and second ends 211, 212 and the third and fourth ends 213, 214 and may each include a single cord body extending between the respective ends. As such, the first and second continuous cords 201, 202 may each include a single looped structure and thus, when extending through the first and second channels 131, 132, portions of the first and second continuous cords 201, 202 may overlap. For example, two portions of each single cord body may extend together through a single passageway of the first and second channels 131, 132 proximate the circumferential opening 120 and separate to individually extend through a dual passageway of the respective first and second channels 131, 132.

With further reference to FIGS. 1-7, the first and second continuous cords 201, 202 may each be secured to the circumferential opening 120 at a single location on opposing sides proximate the right and left side portions 121, 122 by the first and second anchoring structures 111, 112 and may also extend away from the perimeter edge 125 in a single direction via the first and second segments 241, 242. At the first and second junctions 231, 232, the first and second continuous cords 201, 202 may extend away from the perimeter edge 125 in two different directions via the first and second loops 251, 252. At the first and second aperture locations 161, 162, the first and second loops 251, 252 may exit the first and second channels 131, 132 at two different points through the first and second apertures 151, 152, and may further extend outside of the hood portion 110 to form continuous loops.

Upon exiting the first and second channels 131, 132, the first and second loops 251, 252 of the first and second continuous cords 201, 202 may be encased within the sheath 180 and may be releasably secured by the tightening mechanism 170. Accordingly, a wearer may exert, for instance, an outward and backward tension on the first and second loops 251, 252, directly or via the sheath 180, to simultaneously tighten the first and second continuous cords 201, 202 within the first and second channels 131, 132. This tension may be transmitted through the first and second loops 251, 252, to the first and second segments 241, 242 and further to the circumferential opening 120 proximate the right and left side portions 121, 122. Because the first and second segments 241, 242 may be secured to the right and left side portions 121, 122, the transmitted tension may pull the circumferential opening 120 downward over a wearer's face. In addition, because the first and second continuous cords 201, 202 each extend in two differing directions via the first and second loops 251, 252, the tension applied may be directed downward and may further pull a superior portion of the circumferential opening 120 over a wearer's face. Further, the first and second channels 131, 132 may be positioned about the hood portion 110 the first and third portions 141, 143 may laterally direct the tension applied to the first aperture location 161, and the second and fourth portions 142, 144 may downwardly direct the tension applied to the second aperture location 162. Accordingly, the tension applied may be more uniformly directed throughout the hood portion 110 by the first and second channels 131, 132, and as a result, the hood portion 110 is pulled down in multiple directions over a wearer's head.

In further aspects, the tightening mechanism 170 may help to maintain any tension applied to the exposed portions of the first and second loops 251, 252 (via, for instance, friction). In other words, the tightening mechanisms 170 may maintain the portions of the first and second continuous cords 201, 202 within the first and second channels 131, 132 at a fixed length after tension has been applied. Thus, the hood portion 110 and the circumferential opening 120 may be maintained over the wearer's head and face in a relatively static position until the tension is released.

Figure 8:
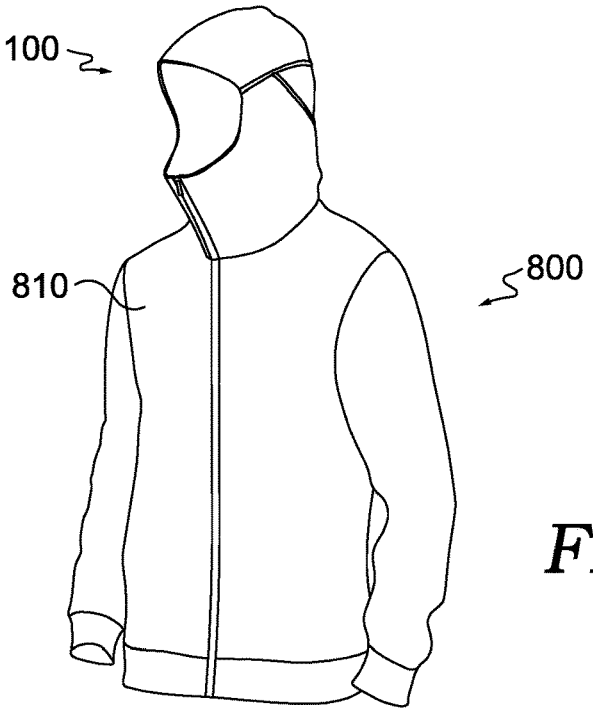
FIG. 8 illustrates a perspective front view of an exemplary apparel item including a hood including a hood adjusting mechanism in accordance with aspects herein.

Turning now to FIG. 8, an apparel item 800 including the hood adjusting mechanism 100 is depicted. The apparel item 800 may comprise a body portion 810 configured to at least partially cover a torso area of a wearer when the apparel item is worn. More specifically, the apparel item 100 is in the form of a jacket/coat. However, it is contemplated herein that the apparel item 100 may take other forms such as a hoodie, a sleeveless jacket, a jacket with partial sleeves, a hoodie with partial sleeves or no sleeves, and the like.

Figure 9:
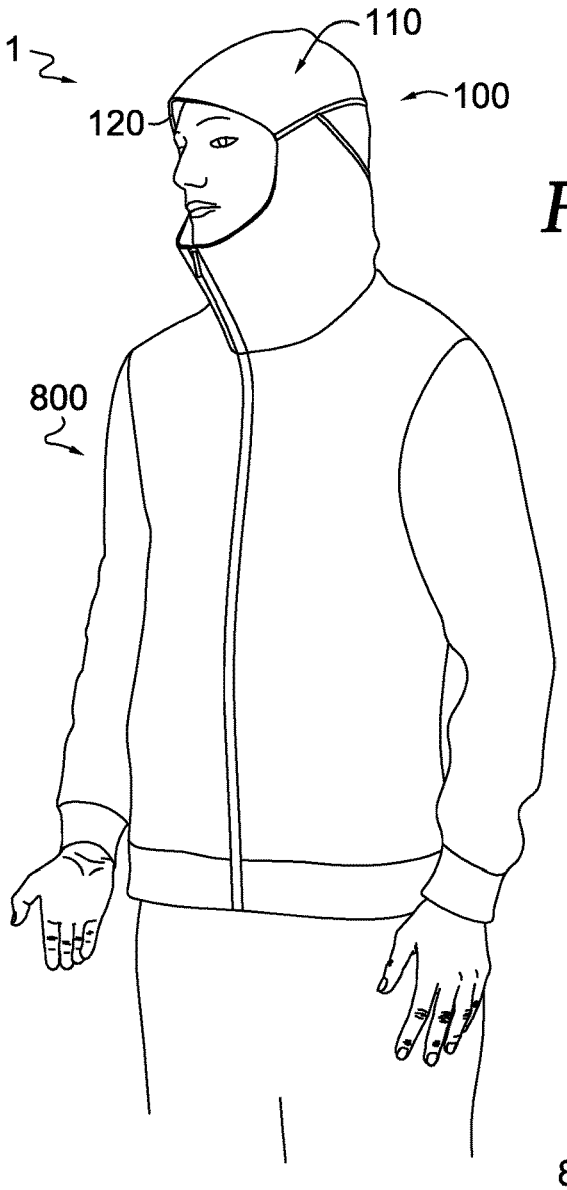
FIG. 9 illustrates a perspective view of the apparel item including the hood including the hood adjusting mechanism of FIG. 8 with the hood adjusting mechanism in a first position in accordance with aspects herein.
Figure 10:
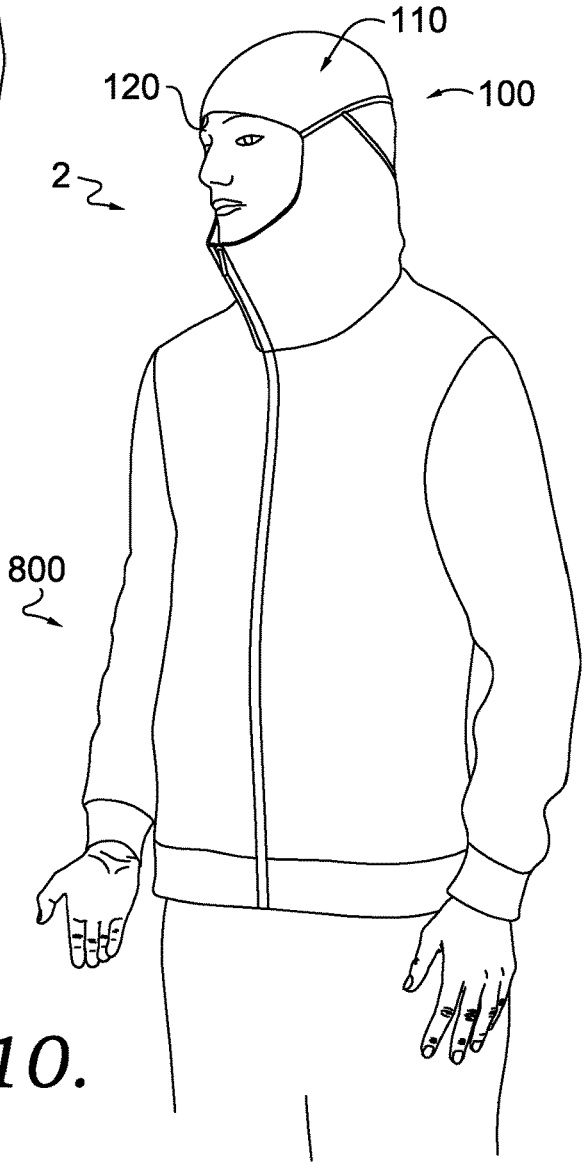
FIG. 10 illustrates a perspective view of the apparel item including the hood including the hood adjusting mechanism of FIG. 8 with the hood adjusting mechanism in a second position in accordance with aspects herein.

FIGS. 9 and 10 illustrate the exemplary hood adjusting mechanism 100 included with the apparel item 800 in an as-worn position on a wearer. With respect to FIG. 9, hood adjusting mechanism 100 is shown in a first position 1. As depicted, in the first position 1, the hood portion 110 extends over the wearer's head, and the circumferential opening 120 forms an opening around the wearer's face. In FIG. 10, the hood adjusting mechanism 100 is shown in a second position 2 in which the first and second continuous cords 201, 202 have been tightened and maintained by the tightening mechanism 170 as disclosed herein. As shown, in the second position 2, the hood portion 110 is pulled tighter over the wearer's head, and the circumferential opening 120 is pulled downward over the wearer's face. More particularly, the posterior, superior and lateral portions of the hood portion 110 and the superior and lateral portions of the circumferential opening 120 are pulled down and tightened. However, the inferior portions of the hood portion 110 and the circumferential opening 120 remain loose providing more comfort to a wearer and also allowing a greater freedom of movement when the wearer needs to, for instance, turn his or her head.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims.

What is claimed is:

1. A hood adjusting mechanism comprising:

a hood portion configured to at least partially cover a head area of a wearer in an as-worn position, the hood portion comprising:

a generally circumferential opening defined at least by a right side portion and a left side portion, a first aperture positioned at a first aperture location on a back side of the hood portion, a second aperture positioned at a second aperture location on the back side of the hood portion, a first channel having a first portion extending from the first aperture location to the right side portion of the circumferential opening and a second portion extending from the second aperture location to the right side portion of the circumferential opening, and a second channel having a third portion extending from the first aperture location to the left side portion of the circumferential opening and a fourth portion extending from the second aperture location to the left side portion of the circumferential opening, a first continuous cord extending through the first portion and the second portion of the first channel and exiting at the first aperture and the second aperture, the first continuous cord further extending between the first aperture and the second aperture, the first continuous cord comprising at least a first end secured to the right side portion of the circumferential opening via a first anchoring structure;

a second continuous cord extending through the third portion and the fourth portion of the second channel and exiting at the first aperture and the second aperture, the second continuous cord further extending between the first aperture and the second aperture, the second continuous cord comprising at least a third end secured to the left side portion of the circumferential opening via a second anchoring structure; and a tightening mechanism proximate to the first aperture location and the second aperture location, the tightening mechanism configured to releasably secure the first continuous cord and the second continuous cord.

2. The hood adjusting mechanism of claim 1, wherein the first anchoring structure is located within the first channel proximate the right side portion of the circumferential opening and the second anchoring structure is located within the second channel proximate the left side portion of the circumferential opening.

3. The hood adjusting mechanism of claim 1, wherein the first continuous cord further comprises a first cord body and a second end and the second continuous cord further comprises a second cord body and a fourth end and wherein the second end is attached to the first cord body at a predetermined length from the first end and the fourth end is attached to the second cord body at a predetermined length from the third end.

4. The hood adjusting mechanism of claim 2, wherein the second portion joins with the first portion between the first anchoring structure and the first aperture location and wherein the fourth portion joins with the third portion between the second anchoring structure and the first aperture location.

5. The hood adjusting mechanism of claim 1, wherein the first aperture location is positioned superior to the second aperture location on the back side of the hood portion, when the hood portion is in the as-worn position.

6. The hood adjusting mechanism of claim 5, wherein the first aperture location and the second aperture location are in substantial vertical alignment on the back side of the hood portion, when the hood portion is in the as-worn position.

7. The hood adjusting mechanism of claim 6, wherein the tightening mechanism comprises a first cord lock positioned adjacent to the first aperture location and a second cord lock positioned adjacent to the second aperture location, when the hood portion is in the as-worn position.

8. The hood adjusting mechanism of claim 1, wherein the first continuous cord and the second continuous cord are made of a material with elastic properties.

9. An apparel item with a hood adjusting mechanism, the apparel item comprising:

a body portion configured to at least partially cover a torso area of a wearer when the apparel item is in an as-worn position;

a hood portion affixed to the body portion and configured to at least partially cover a head area of the wearer in an as-worn position, the hood portion comprising:

a generally circumferential opening defined at least by a right side portion and a left side portion, a first aperture positioned at a first aperture location on a back side of the hood portion, a second aperture positioned at a second aperture location on the back side of the hood portion, a first channel having a first portion extending from the first aperture location to the right side portion of the circumferential opening and a second portion extending from the second aperture location to the right side portion of the circumferential opening, and a second channel having a third portion extending from the first aperture location to the left side portion of the circumferential opening and a fourth portion extending from the second aperture location to the left side portion of the circumferential opening, a first continuous cord extending through the first portion and the second portion of the first channel and exiting at the first aperture and the second aperture, the first continuous cord further extending between the first aperture and the second aperture, the first continuous cord comprising a first end secured to the right side portion of the circumferential opening via a first anchoring structure;

a second continuous cord extending through the third portion and the fourth portion of the second channel and exiting at the first aperture and the second aperture, the second continuous cord further extending between the first aperture and the second aperture, the second continuous cord comprising a third end secured to the left side portion of the circumferential opening via a second anchoring structure; and a tightening mechanism proximate to the first aperture location and the second aperture location, the tightening mechanism configured to releasably secure the first continuous cord and the second continuous cord.

10. The apparel item of claim 9, wherein the first anchoring structure is located within the first channel proximate the right side portion of the circumferential opening and the second anchoring structure is located within the second channel proximate the left side portion of the circumferential opening.

11. The apparel item of claim 10, wherein the second portion joins with the first portion between the first anchoring structure and the first aperture location and wherein the fourth portion joins with the third portion between the second anchoring structure and the first aperture location.

12. The apparel item of claim 9, wherein the first aperture location is positioned superior to the second aperture location on the back side of the hood portion, when the hood portion is in the as-worn position.

13. The apparel item of claim 12, wherein the first aperture location and the second aperture location are in substantial vertical alignment on the back side of the hood portion, when the hood portion is in the as-worn position.

14. The apparel item of claim 13, wherein the tightening mechanism comprises a first cord lock positioned adjacent to the first aperture location and a second cord lock positioned adjacent to the second aperture location, when the hood portion is in the as-worn position.

15. The apparel item of claim 9, wherein the first continuous cord and the second continuous cord are made of a material with elastic properties.

16. A hood adjusting mechanism comprising:

a first cord comprising a first end, a second end, a first cord body extending between the first end and the second end, and a first junction formed by an attachment of the second end to the first cord body at a predetermined distance from the first end, the first cord body comprising a first segment extending from the first end to the first junction and a first loop extending continuously between the first junction and the second end;

a second cord comprising a third end, a fourth end, a second cord body extending between the third end and the fourth end, and a second junction formed by an attachment of the fourth end to the second cord body at a predetermined distance from the third end, the second cord body comprising a second segment extending from the third end to the second junction and a second loop extending continuously between the second junction and the fourth end;

a hood portion configured to at least partially cover a head area of a wearer in an as-worn position, the hood portion comprising:

a generally circumferential opening defined at least by a right side portion and a left side portion, a first aperture positioned at a first aperture location on a back side of the hood portion, a second aperture positioned at a second aperture location on the back side of the hood portion, a first channel extending from the first aperture location to the right side portion of the circumferential opening and further extending from the right side portion of the circumferential opening to the second aperture location, wherein the first cord extends through the first channel, the first loop partially extends through the first channel and exits at the first aperture and the second aperture, and the first end is secured to the right side portion of the circumferential opening, and a second channel extending from the first aperture location to the left side portion of the circumferential opening and further extending from the left side portion of the circumferential opening to the second aperture location, wherein the second cord extends through the second channel, the second loop partially extends through the second channel and exits at the first aperture and the second aperture, and the third end is secured to the left side portion of the circumferential opening; and a tightening mechanism proximate to the first aperture location and the second aperture location, the tightening mechanism configured to releasably secure the first cord and the second cord.

17. The hood adjusting mechanism of claim 16, wherein the first aperture location and the second aperture location are in substantial vertical alignment on the back side of the hood portion, when the hood portion is in the as-worn position.

* * * * *